US009657413B2

(12) United States Patent
Deshpande et al.

(10) Patent No.: US 9,657,413 B2
(45) Date of Patent: May 23, 2017

(54) CONTINUOUS CARBONIZATION PROCESS AND SYSTEM FOR PRODUCING CARBON FIBERS

(71) Applicant: Cytec Industries Inc., Woodland Park, NJ (US)

(72) Inventors: Girish Vishnukant Deshpande, Simpsonville, SC (US); Barry DeWayne Meece, Piedmont, SC (US); Robert Phil Fennell, Belton, SC (US)

(73) Assignee: Cytec Industries Inc., Woodland Park, NJ (US)

( * ) Notice: Subject to any disclaimer, the term of this patent is extended or adjusted under 35 U.S.C. 154(b) by 0 days.

(21) Appl. No.: 14/945,979

(22) Filed: Nov. 19, 2015

(65) Prior Publication Data

US 2016/0160396 A1 Jun. 9, 2016

Related U.S. Application Data

(60) Provisional application No. 62/087,900, filed on Dec. 5, 2014.

(51) Int. Cl.
*D01F 9/32* (2006.01)
*D01F 9/22* (2006.01)

(52) U.S. Cl.
CPC ..... *D01F 9/328* (2013.01); *D01F 9/22* (2013.01); *D01F 9/225* (2013.01)

(58) Field of Classification Search
CPC ..... D01F 9/127; D01F 9/1271; D01F 9/1272; D01F 9/1273; D01F 9/1274; D01F 9/1275; D01F 9/1276; D01F 9/1277; D01F 9/1278; D01F 9/133; D01F 9/14; D01F 9/145;
(Continued)

(56) References Cited

U.S. PATENT DOCUMENTS 4,015,068 A 3/1977 Vohler
4,073,870 A 2/1978 Saji et al.
4,100,004 A 7/1978 Moss et al.
(Continued)

FOREIGN PATENT DOCUMENTS

EP 0338212 10/1989
EP 0516051 B1 12/1997
(Continued)

OTHER PUBLICATIONS

International Search Report. PCT/US2015/062091. Mailing Date: Mar. 1, 2016.

*Primary Examiner* — Daniel C McCracken
(74) *Attorney, Agent, or Firm* — Thi Dang

(57) ABSTRACT

A continuous carbonization method for the carbonization of a continuous, oxidized polyacrylonitrile (PAN) precursor fiber, wherein the precursor fiber exiting the carbonization system is a carbonized fiber which has been exposed to an atmosphere comprising 5% or less, preferably 0.1% or less, more preferably 0%, by volume of oxygen during its passage from a high temperature furnace to the next high temperature furnace. In one embodiment, the carbonization system includes a pre-carbonization furnace, a carbonization furnace, a substantially air-tight chamber between the furnaces, and a drive stand carrying a plurality of drive rollers that are enclosed by the air-tight chamber.

16 Claims, 4 Drawing Sheets

(58) Field of Classification Search
CPC ..... D01F 9/15; D01F 9/16; D01F 9/17; D01F 9/18; D01F 9/20
USPC ..... 423/447.1–447.9
See application file for complete search history.

(56) References Cited

U.S. PATENT DOCUMENTS

| | | | | |
|---|---|---|---|---|
| 4,526,770 | A | 7/1985 | Pepper et al. | |
| 4,900,247 | A | 2/1990 | Takahashi | |
| 5,193,996 | A | 3/1993 | Mullen | |
| 5,908,290 | A | 6/1999 | Kawamura et al. | |
| 6,967,014 | B1 * | 11/2005 | Olry ..... | D01F 9/16 264/29.4 |
| 7,223,376 | B2 | 5/2007 | Panter et al. | |
| 8,603,429 | B2 | 12/2013 | Samejima | |

FOREIGN PATENT DOCUMENTS

| | | |
|---|---|---|
| GB | 1207824 | 10/1970 |
| GB | 2184819 | 7/1989 |
| JP | 62-162020 | 7/1987 |
| JP | 06-173124 | 6/1994 |

* cited by examiner

CONTINUOUS CARBONIZATION PROCESS AND SYSTEM FOR PRODUCING CARBON FIBERS

This application claims the benefit of prior U.S. Provisional Application No. 62/087,900 filed on Dec. 5, 2014, the content of which is incorporated herein in its entirety.

BACKGROUND

Carbon fibers have been used in a wide variety of applications because of their desirable properties such as high strength and stiffness, high chemical resistance, and low thermal expansion. For example, carbon fibers can be formed into a structural part that combines high strength and high stiffness, while having a weight that is significantly lighter than a metal component of equivalent properties. Increasingly, carbon fibers are being used as structural components in composite materials for aerospace applications. In particular, composite materials have been developed in which carbon fibers serve as a reinforcing material in a resin or ceramic matrix.

In order to meet the rigorous demands of the aerospace industry, it is desirable to continually develop new carbon fibers having both high tensile strength (1,000 ksi or greater) and high modulus of elasticity (50 Msi or greater), as well as having no surface flaws or internal defects. Carbon fibers having individually higher tensile strength and modulus can be used in fewer quantities than lower strength carbon fibers and still achieve the same total strength for a given carbon fiber-reinforced composite part. As a result, the composite part containing the carbon fibers weighs less. A decrease in the structural weight is important to the aerospace industry because it increases the fuel efficiency and/or increases the load carrying capacity of the aircraft incorporating such a composite part.

DETAILED DESCRIPTION

Figure 1:
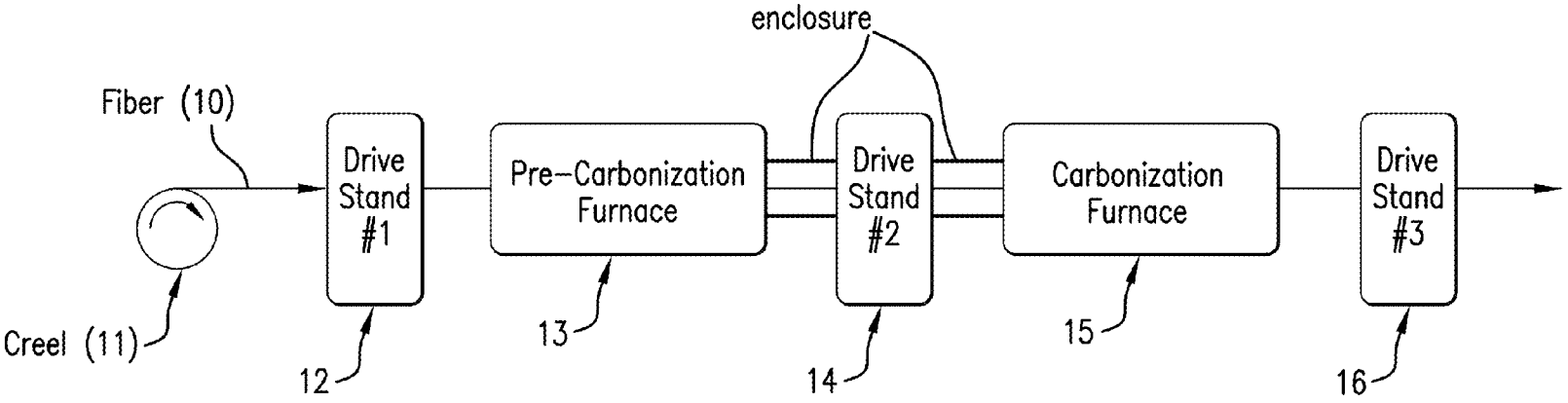
FIG. 1 schematically illustrates a continuous carbonization process and system according to one embodiment of the present disclosure.

Carbon fibers can be manufactured by forming a polyacrylonitrile (PAN) fiber precursor (i.e. white fiber) then converting the fiber precursor in a multi-step process in which the fiber precursor is heated, oxidized, and carbonized to produce a fiber that is 90% or greater carbon. To make the PAN fiber precursor, a PAN polymer solution (i.e. spin "dope") is typically subjected to conventional wet spinning and/or air-gap spinning. In wet spinning, the dope is filtered and extruded through holes of a spinneret (made of metal) into a liquid coagulation bath for the polymer to form filaments. The spinneret holes determine the desired filament count of the PAN fiber (e.g., 3,000 holes for 3K carbon fiber). In air-gap spinning, the polymer solution is filtered and extruded in the air from the spinneret and then extruded filaments are coagulated in a coagulating bath. The spun filaments are then subjected to a first drawing to impart molecular orientation to the filaments, washing, drying, and then subjected to a second drawing for further stretching. The drawing is usually performed in a bath such as hot water bath or steam.

To convert the PAN fiber precursors or white fibers into carbon fibers, the PAN white fibers are subjected to oxidation and carbonization. During the oxidation stage, the PAN white fibers are fed under tension or relax through one or more specialized ovens, into which heated air is fed. During oxidation, which is also referred to as oxidative stabilization, the PAN precursor fibers are heated in an oxidizing atmosphere at a temperature between about 150° C. to 350° C., preferably 300° C. to cause the oxidation of the PAN precursor molecules. The oxidation process combines oxygen molecules from the air with the PAN fiber and causes the polymer chains to start crosslinking, thereby increasing the fiber density. Once the fiber is stabilized, it is further processed by carbonization through further heat treating in a non-oxidizing environment. Usually, the carbonization takes place at temperatures in excess of 300° C. and in a nitrogen atmosphere. Carbonization results in the removal of hetero atoms and development of planar carbon molecules like graphite and consequently produces a finished carbon fiber that has more than 90 percent carbon content.

In conventional carbonization processes for producing carbon fibers, air is trapped within the fiber tows and is traveling with the tows as they enter the heating furnaces. Oxygen is carried by the tows into the furnaces, in the pores of the tows and between the filaments in the tow. Nitrogen in the furnace throat strips part of this oxygen. Once the fibers are exposed to the high-temperature atmosphere inside a carbonization furnace, the air would come out of the tow due to thermal expansion. During carbonization, the oxidative species on carbon fiber surface, formed by the reaction of oxygen in the fiber tows with the carbon fiber filaments in the fiber tows, are carbonized. The oxygen combines with a carbon atom from the surface of a filament and is lost as carbon monoxide. The flaw introduced on the carbon fiber surface due to oxidation, similar to etching, remains on the fiber surface during carbonization and is not fully healed. This flaw causes the reduction in tensile strength. There are many solutions proposed in literature and carried out in practice to strip the air from the fiber tows as they enter a furnace. However, these solutions do not provide an effective way to prevent air from getting into the tows during their passage between furnaces.

Disclosed herein is a continuous carbonization method for the carbonization of a continuous, oxidized polyacrylonitrile (PAN) precursor fiber, wherein the fiber exiting the carbonization system is a carbonized fiber which has been exposed to an atmosphere comprising 5% or less, preferably 0.1% or less, more preferably 0%, by volume of oxygen during its passage from a high temperature furnace to the next high temperature furnace.

The carbonization method of the present disclosure involves the use of two or more heating furnaces that are disposed adjacent one another in a serial end to end relationship and are configured to heat the fiber to different temperatures as the fiber is passing through the furnaces. Two or more drive stands with drive rollers are positioned along the fiber passage. The exit of each furnace is connected to the entrance of the next furnace by a substantially air-tight enclosure, which may enclose the drive rollers of a drive stand.

According to one embodiment, the continuous carbonization method and system of the present disclosure is schematically illustrated by FIG. 1. In this embodiment, a continuous, oxidized polyacrylonitrile (PAN) precursor fiber 10 supplied by a creel 11 is drawn through a carbonization system which includes:

a) a first drive stand 12 carrying a series of rollers rotating at a first speed (V1);

b) a pre-carbonization furnace 13;

c) a second drive stand 14 carrying a series of rollers rotating at a second speed (V2) which is greater than or equal to V1 (or V2≥V1);

d) a carbonization furnace 15; and e) a third drive stand 16 carrying a series of drive rollers rotating at a third speed (V3) which is less than or equal to V2 (V3≤V2).

The precursor fiber 10 may be in the form of a fiber tow which is a bundle of multiple fiber filaments, e.g. 1,000 to 50,000. A single fiber tow may be supplied from the creel to the first drive stand 12, or alternatively, a plurality of creels are provided to supply two or more tows which run in parallel through the carbonization system. A multi-position creel could also be used to supply two or more tows to drive stand 12.

The pre-carbonization furnace 13 may be a single-zone or a multi-zone gradient heating furnace operating within a temperature range of about 300° C. to about 700° C., preferably it is a multi-zone furnace with at least four heating zones of successively higher temperatures. The carbonization furnace 15 may be a single-zone or a multi-zone gradient heating furnace operating at a temperature of greater than 700° C., preferably about 800° C. to about 1500° C. or about 800° C. to about 2800° C., preferably it is a multi-zone furnace with at least five heating zones of successively higher temperatures. During the fiber passage through the pre-carbonization and carbonization furnaces, the fiber is exposed to a non-oxidizing, gaseous atmosphere containing an inert gas, e.g. nitrogen, helium, argon, or mixture thereof, as a major component. The residence time of the precursor fiber through the precarbonization furnace may range from 1 to 4 minutes, and the residence time through the carbonization furnace may range from 1 to 5 minutes. The line speed of the fiber through the furnaces may be about 0.5 m/min to about 4 m/min.

In a preferred embodiment, the pre-carbonization and carbonization furnaces are horizontal furnaces which are horizontally disposed relative to the path of the precursor fiber. A high amount of volatile byproducts and tars are generated during pre-carbonization, as such, the pre-carbonization furnace is configured to remove such byproducts and tars. Examples of suitable furnaces are those described in U.S. Pat. No. 4,900,247 and European Patent No. EP 0516051.

Figure 2:
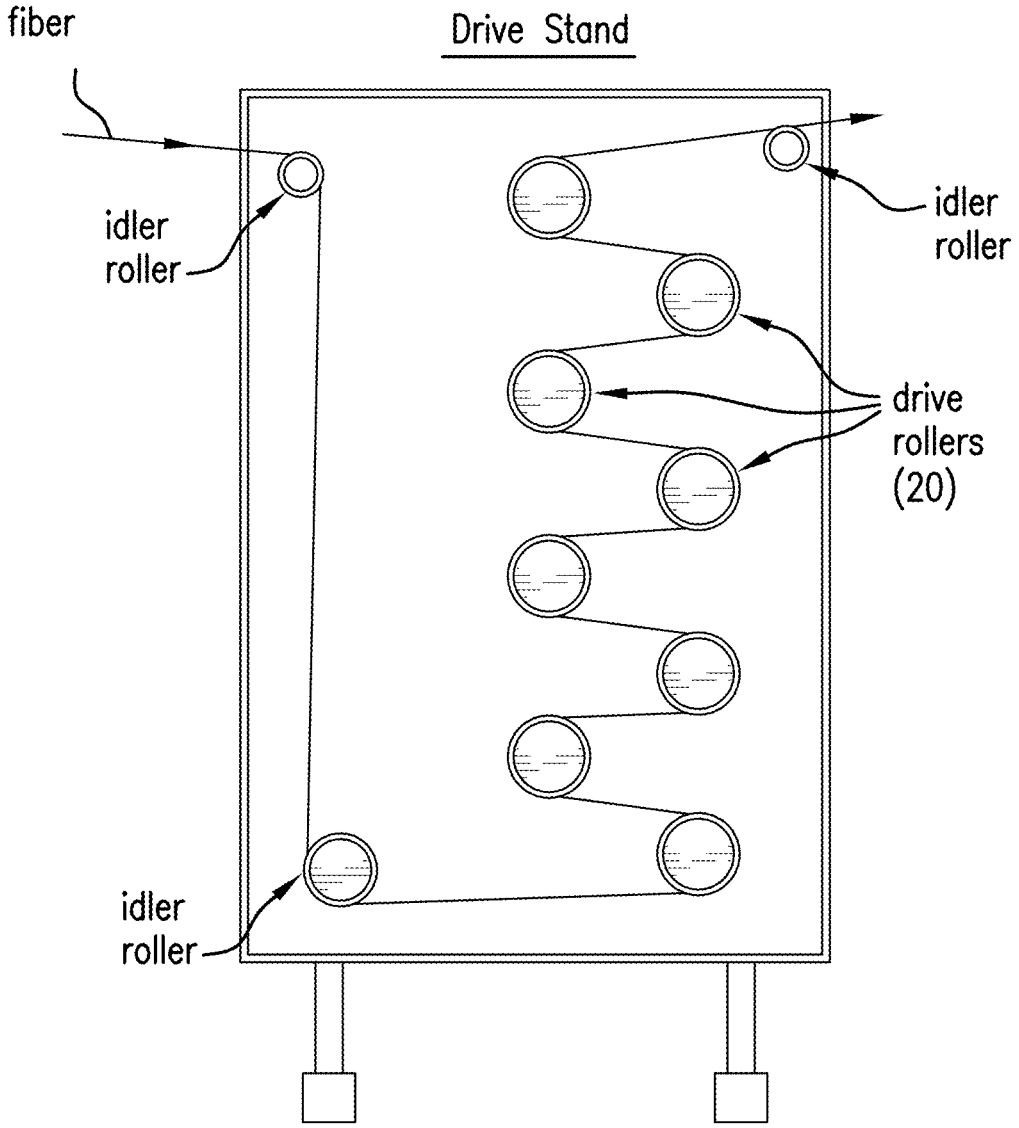
FIG. 2 depicts an exemplary configuration for a drive stand that can be used in the carbonization method disclosed herein.

FIG. 2 schematically illustrates an exemplary configuration for the drive stands 12 and 16. The drive stand carries a plurality of drive rollers 20, which are arranged to provide a winding/serpentine path for the precursor fiber. The drive stand also has idler rollers (which are rotatable but not driven) to guide the precursor fiber into and out of the drive stand. The drive rollers of each drive stand are driven to rotate at a relative speed by a variable speed controller (not shown).

Referring to FIG. 1, the precursor fiber passage between the pre-carbonization furnace 13 and the carbonization furnace 15 is enclosed to prevent air from the surrounding atmosphere to enter into the furnaces. Moreover, the rollers of the second drive stand 14 are enclosed in an air-tight chamber. The air-tight chamber is located between and connected to the pre-carbonization furnace 13 and the carbonization furnace 15 such that no air from the surrounding atmosphere can enter into the pre-carbonization furnace, the carbonization furnace or the air-tight chamber that enclosed the rollers of the second drive stand 14.

Figure 3:
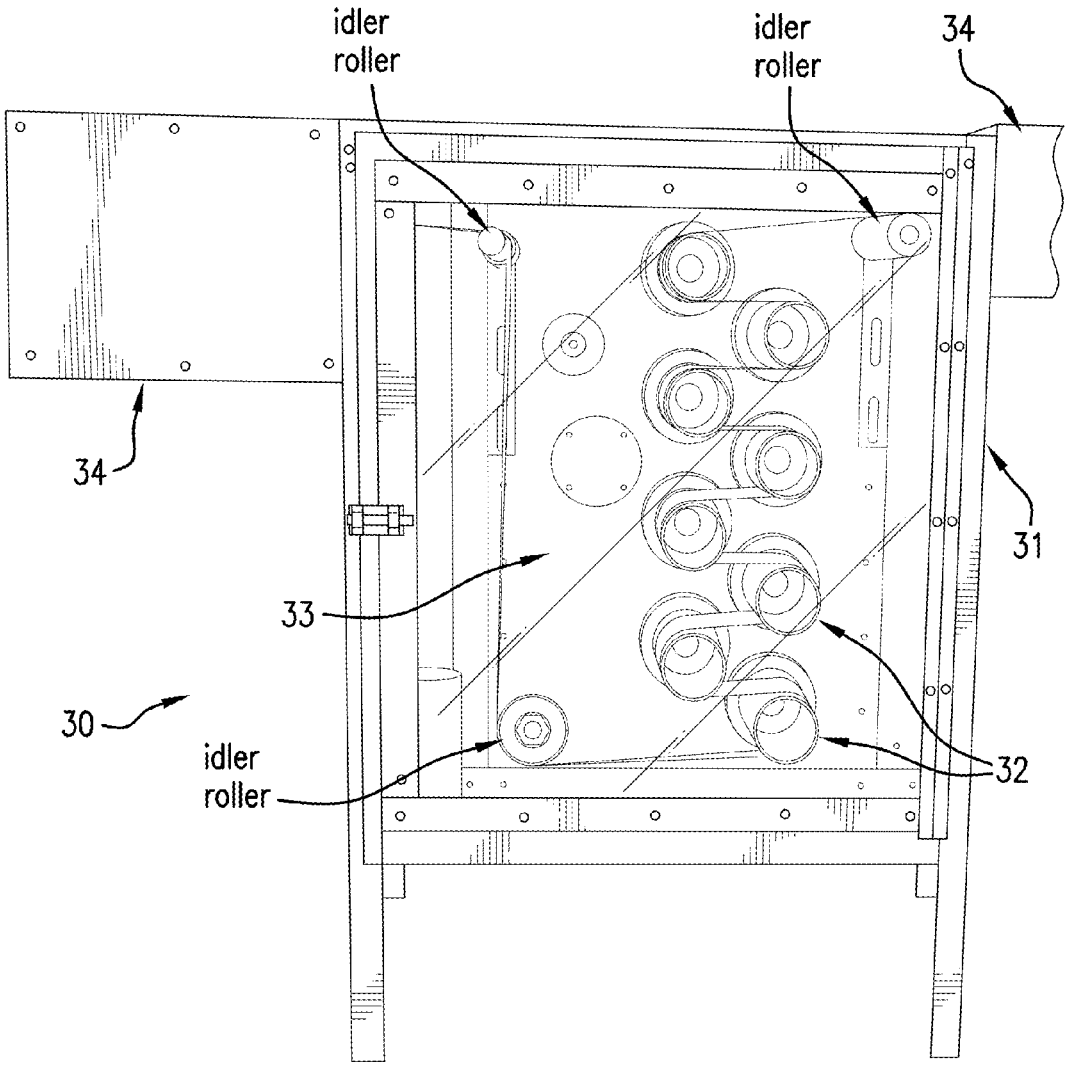
FIG. 3 shows a drive stand with an air-tight chamber enclosing the rotatable rollers of a drive stand, according to an embodiment of the present disclosure.

FIG. 3 illustrates an exemplary drive stand 30 with a substantially air-tight chamber 31 which encloses drive rollers 32. The substantially air-tight chamber 31 has an access door 33 which can be opened to allow the "string-up" of the precursor fiber through the furnaces at the beginning of the carbonization process. The term "string-up" refers to the process of wrapping the tows around the rollers and threading the tows through the furnaces prior to the start-up of the carbonization process. Preferably, the access door 33 has a transparent (e.g. glass) panel so that the rollers 32 are visible to the operator. The drive stand 30 also has idler rollers to guide the fiber into and out of the drive stand. Furthermore, the passage way 34 between the chamber 31 and the adjacent furnace is enclosed.

According to one embodiment, the substantially air-tight chamber that encloses the drive stand is sealed to maintain a positive pressure differential with respect to atmospheric pressure. However, the air-tight chambers are configured to allow a controlled leak of inert gas to the atmosphere, e.g. via vents or leaving some seams/joints unsealed, in order to prevent pressure buildup in the chamber. It is preferred that no vacuuming is applied to the air-tight chamber. Also, it is preferred that, aside from the rotatable rollers and guide rollers described above, there are no other structures, such as nip rollers, making physical contact with the precursor fiber during its passage from the pre-carbonization furnace to the carbonization furnace. The presence of nip rollers would likely cause abrasion to the fiber, which in turn result in fuzzy fibers. However, support rollers and load cells can be used to address the catenary effect. The term "catenary effect" refers to the phenomenon where the fiber tow sags due to its own weight when travelling over long distances unsupported by rollers.

During the operation of the carbonization system shown in FIG. 1, the oxidized PAN precursor fiber 10 supplied by the creel 11 makes direct wrapping contact with the drive rollers of the first drive stand 12 in a winding/serpentine path prior to entering the pre-carbonization furnace 13, and the precursor fiber exiting the pre-carbonization furnace 13 then makes direct wrapping contact with the drive rollers of the second drive stand 14 prior to entering the carbonization furnace 15. The third drive stand 16 is not enclosed and is the same as the first drive stand 12. The relative speed differential between the first drive stand 12 and the second drive stand 14 is designed to stretch the fiber up to 12% to increase orientation. During its passage through the carbonizing furnace 15, the fiber is allowed to shrink to a predetermined amount, up to 6%, by the speed differential between the second drive stand 14 and the third drive stand 16. The amount of stretch and/or relax between each pair of drive stands will vary depending on the product properties required for the final product.

Figure 4:
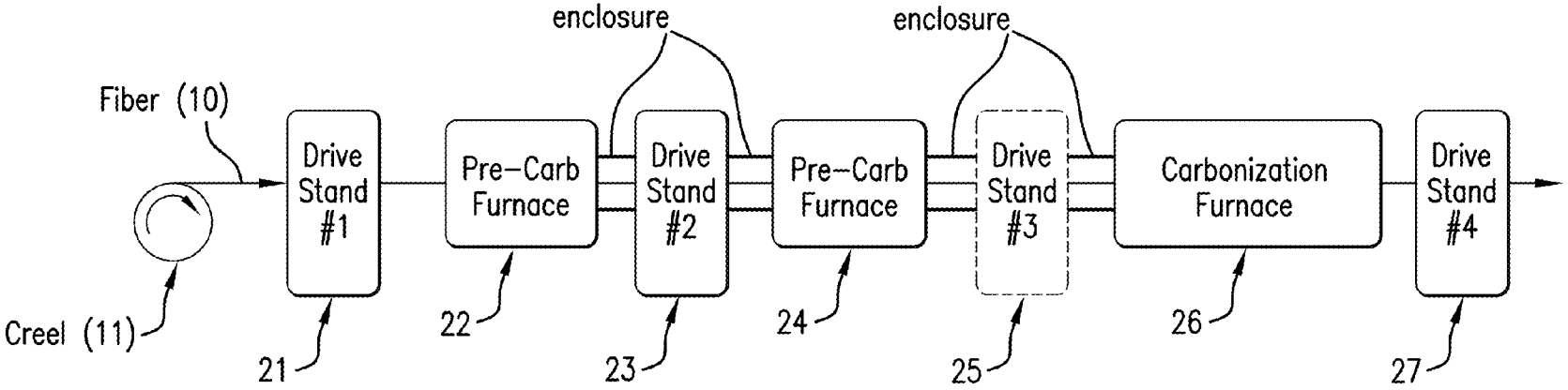
FIG. 4 illustrates a carbonization process and system according to another embodiment.

FIG. 4 illustrates another embodiment of the carbonization system. The system shown in FIG. 4 is similar to that shown in FIG. 1 with the difference being the addition of a second pre-carbonization furnace 24 between the first pre-carbonization furnace 22 and the carbonization furnace 26. The second pre-carbonization furnace 24 is operating at about room temperature (20° C.-30° C.). The first drive stand 21 (not enclosed) and the second drive stand 23 (enclosed) are as described above with reference to the drive stands shown in FIGS. 2 and 3, respectively. An optional enclosed drive stand 25 may be provided between the second pre-carbonization furnace 24 and the carbonization furnace 26. The enclosed drive stand 25 is as described above and shown in FIG. 3. If the enclosed drive stand 25 is not present, then the passage way between the second pre-carbonization furnace 24 and the carbonization furnace 26 is enclosed and substantially air-tight with no structure therein to make physical contact with the passing fiber, but optionally, support rollers may be provided to prevent fiber sagging as discussed previously. The first drive stand 21 and the fourth drive stand 27 are not enclosed. The drive rollers of the second drive stand 23 are rotating at a higher speed relative to the drive rollers of the first drive stand 21 to provide stretching. If the third drive stand 25 is present, its drive rollers are rotating at approximately the same speed as that of the rollers of the second drive stand 23. The drive rollers of the drive stand 27 are rotating up to 6% slower than drive stand 23 to accommodate shrinkage of fiber through carbonization.

Figure 5:
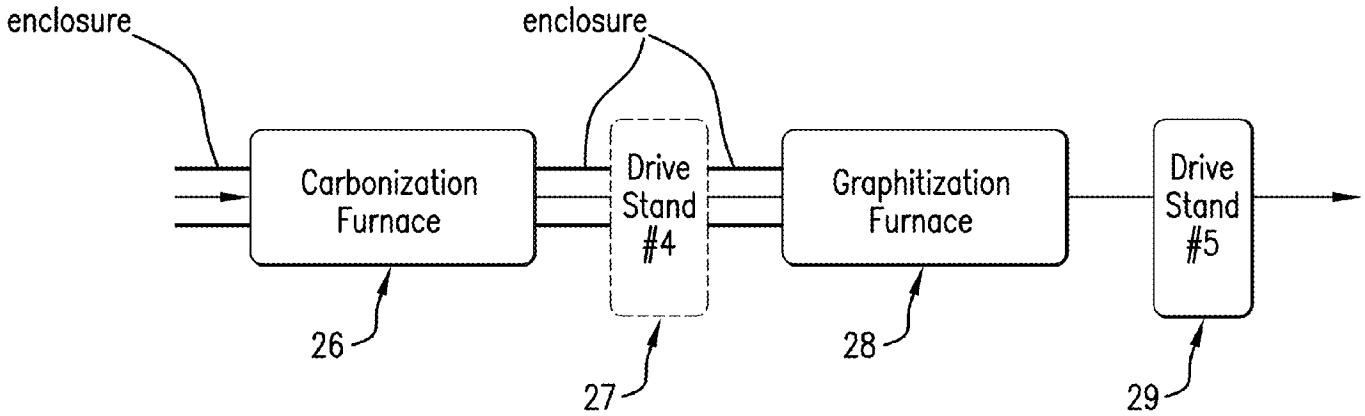
FIG. 5 illustrates a carbonization process and system according to another embodiment.

FIG. 5 illustrates yet another embodiment of the carbonization system. In this embodiment, the carbonized fiber exiting the carbonization furnace 26 passes through an optional fourth enclosed drive stand 27, then passes through a single-zone or multi-zone graphitization furnace, prior to its passage through a fifth drive stand 29 (which is not enclosed). The third drive stand 25 and the fourth drive stand 27 are optional, but if they are present, then the rollers of the fourth drive stand 27 are rotating at a slower speed than that of the drive rollers of the third drive stand 25. The passage way between the carbonization furnace and the drive stand 27 (if present) is enclosed and air-tight as described above, as well as the passage way between the drive stand 27 and the graphitization furnace. If the fourth drive stand 27 is not present, then the passage way between the carbonization furnace 26 and the graphitization furnace 28 is enclosed and substantially air-tight with no structure therein to make physical contact with the passing fiber but support rollers and load cells may be used to address the catenary effect discussed above. The graphitization furnace operates within a temperature range of greater than 700° C., preferably about 900° C. to about 2800° C., in some embodiments, about 900° C. to about 1500° C. The fiber passing through the graphitization furnace is exposed to a non-oxidizing, gaseous atmosphere containing an inert gas, e.g. nitrogen, helium, argon, or mixture thereof. The residence time of the fiber through the graphitization furnace may range from about 1.5 to about 6.0 minutes. Graphitization can result in fibers in excess of 95% carbon content. According to one embodiment, carbonization is carried out in the temperature range of about 700° C. to about 1500° C. then graphitization is carried out in the temperature range of about 1500° C. to about 2800° C. At about 2800° C., graphitization can result in fibers in excess of 99% carbon content. If the carbonization furnace 26 has more than five gradient heating zones and the heating temperature of the carbonization furnace can reach up to 1500° C. or higher, then the graphitization furnace is not needed.

FIGS. 1 and 4 show the oxidized PAN fiber 10 as being supplied by the creel 11, but alternatively, carbonization may be part of a continuous oxidization and carbonization process. In such case, a PAN fiber precursor passes firstly through one or more oxidizing furnaces or zones to affect complete internal chemical transformation from PAN precursor to stabilized fiber, as is well known in the art. Then, without delay, the oxidized/stabilized fiber advances through the carbonization system described with reference to FIG. 1. In other words, the oxidized fiber may advance directly from an oxidizing furnace to the first drive stand in FIG. 1 or FIG. 4.

The carbon fibers treated according to the carbonization process disclosed herein are substantially free of trapped oxygen during the carbonization process resulting in less fiber surface damage, and are of high tensile strength (e.g. 800 ksi or 5.5 GPa) and high tensile modulus (e.g. 43 Msi or 296 GPa).

After completion of carbonization and graphitization (if included), the carbonized fiber may then be subjected to one or more further treatments including surface treatments and/or sizing either immediately in a continuous flow process or after a delay. Surface treatments include anodic oxidation in which the fiber is passed through one or more electrochemical baths. Surface treatments may aid in improving fiber adhesion to matrix resins in the composite material. Adhesion between the matrix resin and carbon fiber is an important criterion in a carbon fiber-reinforced polymer composite. As such, during the manufacture of carbon fiber, surface treatment may be performed after oxidation and carbonization to enhance this adhesion.

Sizing typically involves passing the fibers through a bath containing a water-dispersible material that forms a surface coating or film to protect the fiber from damage during its use. In composite manufacturing, the water-dispersible material is generally compatible with matrix resin targeted for the composite material. For example, the carbonized fibers can be surface treated in an electrochemical bath, and then sized with a protective coating for use in the preparation of structural composite materials, such as prepregs.

EXAMPLES

Example 1

A carbonization process was run using the set-up shown in FIG. 5 with the drive stand #4 (27) enclosed. An oxidized fiber tow composed of 3000 filaments was passed through drive stand #1 operating at speed V1 of 2.8 ft/min (85.34 cm/min) and then through the first pre-carbonization furnace (22) where the fibers were heated to a temperature range of about 460° C. to about 700° C. and while impinging nitrogen gas to the fiber tow. During passage through the first pre-carbonizing furnace, the tow was stretched about 7.1% relative to the original length of the precursor fiber tow. Drive stand #2 (23) was operating at speed V2 of 3.0 ft/min (91.44 cm/min). The fiber tow then passed through the second pre-carbonization furnace (24) operating at room temperature.

Next, the previously heated and pre-carbonized tow was passed through a carbonization furnace (26) having five heating zones where the tow was heated from about 700° C. to 1300° C., and then passed through a one-zone graphitization furnace (28) where the tow was heated at a temperature of about 1300° C., while maintaining a shrinkage (negative stretch) of the tow of about −3.0%. Drive stands #3 and 4 were not used. Drive stand #5 was operating at a speed of 2.91 ft/min (88.7 cm/min).

The resulting tow of carbon fibers had a high average (n=6) tensile strength of about 815,000 psi (5.62 Gpa) and an average (n=6) tensile modulus of about 43,100,000 psi (297.2 Gpa).

Example 2

For comparison, the process of Example 1 was repeated except that the enclosure for drive stand #4 in FIG. 5 was open. The resulting tow of carbon fibers had an average (n=6) tensile strength of about 782,000 psi (5.39 Gpa) and an average (n=6) tensile modulus of about 43,000,000 psi (296.5 Gpa). As can be seen from the results, the carbon fiber tow produced in Example 2 is lower in tensile strength than that produced in Example 1.

While various embodiments are described herein, it will be appreciated from the specification that various combinations of elements, variations of embodiments disclosed herein may be made by those skilled in the art, and are within the scope of the present disclosure. In addition, many modifications may be made to adapt a particular situation or material to the teachings of the embodiments disclosed herein without departing from essential scope thereof. Therefore, it is intended that the claimed invention not be limited to the particular embodiments disclosed herein, but that the claimed invention will include all embodiments falling within the scope of the appended claims.

What is claimed is:

1. A continuous carbonization method comprising passing a continuous, oxidized polyacrylonitrile (PAN) precursor fiber through a carbonization system, said carbonization system comprising:

a) a first drive stand comprising a series of drive rollers rotating at a first speed (V1);

b) a pre-carbonization furnace configured to contain inert gas and supply heat within a temperature range of about 300° C. to about 700° C.;

c) a carbonization furnace configured to contain inert gas and supply heat at a temperature range of about 800° C. to about 2800° C.;

d) a first substantially air-tight chamber located between and connected to the pre-carbonization furnace and the carbonization furnace such that no air from surrounding atmosphere can enter into the pre-carbonization furnace, the carbonization furnace or the air-tight chamber;

e) a second drive stand comprising a series of drive rollers rotating at a second speed (V2) which is greater than or equal to V1 (or V2≥V1), the second drive being positioned between the pre-carbonization furnace and the carbonization furnace, and the drive rollers of the second drive stand are enclosed by said air-tight chamber, wherein the oxidized PAN fiber makes direct wrapping contact with the rollers of the first drive stand prior to entering the pre-carbonization furnace, and the precursor fiber exiting the pre-carbonization furnace then makes direct wrapping contact with the rollers of the second drive stand prior to entering the carbonization furnace, and wherein the fiber exiting the carbonization furnace is a carbonized fiber which has been exposed to an atmosphere comprising 5% or less by volume of oxygen during its passage from the pre-carbonization furnace to the carbonization furnace.

2. The continuous carbonization method of claim 1 further comprising:

a third drive stand comprising a series of drive rollers rotating at a third speed (V3) which is less than or equal to V2, wherein the third drive stand is positioned downstream from the carbonization furnace along an advancing path of the fiber.

3. The continuous carbonization method of claim 1, wherein each of the first pre-carbonization furnace and the carbonization furnace comprises multiple gradient heating zones.

4. The continuous carbonization method of claim 1, wherein the first substantially air-tight chamber is sealed to maintain a positive pressure differential with respect to atmospheric pressure.

5. The continuous carbonization method of claim 1, wherein the first air-tight chamber is configured to allow a controlled leak of inert gas to the atmosphere in order to prevent pressure buildup in the chamber.

6. The continuous carbonization method of claim 1, wherein the first substantially air-tight chamber is configured to have an access door, which can be opened.

7. The continuous carbonization method of claim 1, wherein the first substantially air-tight chamber is not under vacuum pressure.

8. The continuous carbonization method of claim 1 further comprising:

a graphitization furnace configured to contain inert gas and supply heat within a temperature range of about 900° C. to about 2800° C.; and a second substantially air-tight chamber located between and connected to the carbonization furnace and the graphitization furnace such that no air from surrounding atmosphere can enter into the carbonization furnace, the graphitization furnace, or the second substantially air-tight chamber.

9. The continuous carbonization method of claim 8, wherein the second substantially air-tight chamber comprises an access door, which can be opened.

10. The continuous carbonization method of claim 1, wherein the inert gas in the pre-carbonization furnace and the carbonization furnace is selected from nitrogen, argon, helium, and mixture thereof.

11. The continuous carbonization method of claim 1, wherein the pre-carbonization furnace is a multi-zone furnace with at least four heating zones of successively higher temperatures, and the carbonization furnace is a multi-zone furnace with at least five heating zones of successively higher temperatures.

12. The continuous carbonization method of claim 8, wherein the inert gas in the graphitization furnace is selected from nitrogen, argon, helium, and mixture thereof.

13. The continuous carbonization method of claim 1, wherein the fiber exiting the carbonization furnace is a carbonized fiber which has been exposed to an atmosphere comprising about 0.1% or less by volume of oxygen during its passage from the pre-carbonization furnace to the carbonization furnace.

14. A continuous processing system for carbonizing a precursor fiber, comprising:

a) a first drive stand comprising a series of drive rollers rotatable at a first speed (V1);

b) a creel for supplying a continuous, oxidized polyacrylonitrile (PAN) precursor fiber to the first drive stand;

c) a pre-carbonization furnace comprising multiple gradient heating zones and operable to supply heat at a temperature range of about 300° C. to about 700° C.;

d) a carbonization furnace comprising multiple gradient heating zones and operable to supply heat within a temperature range of about 800° C. to about 2800° C.;

e) a substantially air-tight chamber located between and connected to the pre-carbonization furnace and the carbonization furnace such that no air from surrounding atmosphere can enter into the pre-carbonization furnace, the carbonization furnace or the substantially air-tight chamber;

f) a second drive stand comprising a series of drive rollers rotatable at a second speed (V2), the second drive being positioned between the pre-carbonization furnace and the carbonization furnace, wherein the drive rollers of the second drive stand are enclosed by said air-tight chamber, g) a third drive stand comprising a series of drive rollers rotating at a third speed (V3), wherein the third drive stand is positioned downstream from the carbonization furnace along an advancing path of the fiber; and h) a plurality of idler rollers arranged along a conveying path for guiding the precursor fiber through the pre-carbonization furnace, the carbonization furnace, and the drive stands.

15. The continuous processing system of claim 14, wherein the pre-carbonization furnace is a multi-zone furnace with at least four heating zones of successively higher temperatures, and the carbonization furnace is a multi-zone furnace with at least five heating zones of successively higher temperatures.

16. The continuous processing system of claim 14, wherein the substantially air-tight chamber is configured to have an access door, which can be opened.

* * * * *